United States Patent [19]

Pairis

[11] 4,279,280

[45] Jul. 21, 1981

[54] INTERCHANGEABLE DADO SHAFT ASSEMBLY FOR CIRCULAR SAWS

[76] Inventor: Raul R. Pairis, 21256 Garndal St., Walnut, Calif. 91789

[21] Appl. No.: 93,856

[22] Filed: Nov. 13, 1979

[51] Int. Cl.[3] ..... B27C 9/02

[52] U.S. Cl. ..... 144/1 F; 30/122; 144/218; 144/222

[58] Field of Search ..... 83/666; 30/121, 122, 30/374; 144/218, 222, 1 E, 1 F

[56] References Cited

U.S. PATENT DOCUMENTS

| | | | |
|---|---|---|---|
| 476,677 | 6/1892 | Oliver | 144/222 |
| 1,763,463 | 6/1930 | Garthe | 144/222 |
| 2,854,042 | 9/1958 | Robinson | 83/666 |
| 3,986,259 | 10/1976 | McReynolds et al. | 144/222 |

*Primary Examiner*—W. D. Bray

*Attorney, Agent, or Firm*—Boniard I. Brown

[57] ABSTRACT

An auxiliary dado shaft to support a plurality of rotary saw blades in a laminated pack for cutting wide grooves and dados, is provided with a central bore for receiving a through bolt for simultaneous securement of the blades together and engagement of a mating thread in the motor drive shaft. A tubular socket on the inboard end of the auxiliary dado shaft is adapted to engage the stubshaft of the drive motor and is secured thereto.

7 Claims, 7 Drawing Figures

INTERCHANGEABLE DADO SHAFT ASSEMBLY FOR CIRCULAR SAWS

BACKGROUND OF THE INVENTION

The invention relates to improved auxiliary means for cutting grooves and dados with hand-held construction saws; it relates, more particularly, to interchangeable dado shafts for hand-held saws.

The cutting of wide grooves is a frequent requirement in carpentry, ranging from millwork to cabinetmaking. It is a particularly difficult operation to perform in construction carpentry where the timbers to be grooved may be particularly unwieldy and, consequently, the use of stationary saws—for which class dadoing attachment are readily available—is not practical due to the time consumption and labor involved in moving the piece to be grooved to the saw, in making the cut, and subsequently carrying the grooved timber to its location in the structure.

Many cutting procedures, including ripping and cross-cutting, are readily accomplished with the aid of portable, hand-held saws common in the construction trades. These saws, however, are not equipped with saw mandrels capable of receiving dado kits—commonly packs of saw blades whose combined width corresponds to the width of the groove to be cut—and are not suited to performing dadoing operations.

It is, therefore, the primary object of the invention to provide auxiliary, interchangeable shaft means for portable circular saws capable of mounting and driving a plurality of parallel saw blades forming a dado-cutting gang.

It is an additional object of the invention to provide such interchangeable shaft means in a form readily adapted to commonly employed construction hand-held saws, and to teach the construction and use of such auxiliary components as may render the operation of such saws in dadoing work safe and convenient.

SUMMARY OF THE INVENTION

The foregoing objects and advantages are attained in an auxiliary kit enabling dadoing operations to be performed with a portable, hand-held circular saw. This kit is based on a dado shaft with a tubular socket at one end and a central orifice therethrough.

The tubular socket of the dado shaft engages the end of the stub-shaft issuing from the drive motor of the aforesaid portable saw and is secured thereto by means of a setscrew or similar fixing device. A flange extends from the surface of the dado shaft, intermediate between the tubular socket and the shank thereof, to serve as an abutment for the dado saw blade pack. The dado-cutting blades are conventional in construction and in a preferred mode of employment of the invention comprise two circular saw blades at either flank of the pack and at least one partial blade intermediately located between them.

The axial extent of the constant-diameter shank of the dado shaft corresponds to the maximum width of a groove to be cut with the aid thereof, as well as the flanking washers as may be required to securely transmit the cutting torque of the drive motor to the blades in the dado pack. An axial preload to generate the frictional forces, through which the aforesaid drive torque is developed, is provided by means of a bolt passing through the central orifice of the auxiliary shaft in mating engagement with a threaded socket central in the drive-motor stub-shaft.

The blades employed in the auxiliary groove-cutting assembly of the invention are conventional in the woodworking arts; the other components utilized therein are manufactured with techniques and out of materials analogous to similar parts in other types of woodworking machinery.

It is foreseen that, in a preferred embodiment of the invention, the guide plate of the hand-held circular saw and the safety cover employed to surmount the saw blades used therein are replaced by components particularly adapted to receive the dado-cutting blade pack whose utilization is made possible by the employment of the interchangeable dado shaft assembly of the invention.

BRIEF DESCRIPTION OF THE ACCOMPANYING DRAWING

The preferred embodiment of the invention will be described in detail, below, with reference to the accompanying drawing, wherein.

DESCRIPTION OF THE PREFERRED EMBODIMENT

Figure 1:
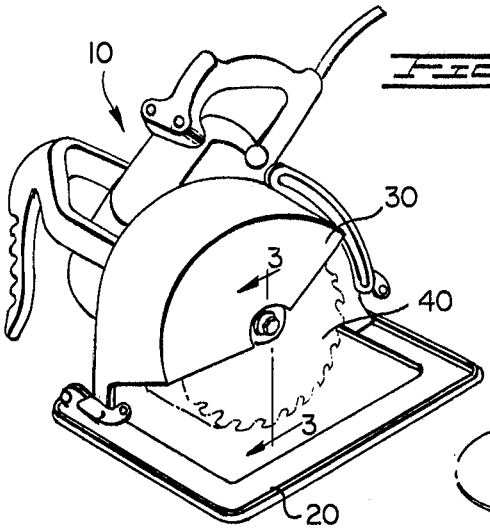
FIG. 1 is a perspective view of a hand-held, portable, rotary construction saw with integral electric drive motor, equipped with an auxiliary, removable dado shaft assembly of the invention, and with a guide plate and blade guard to accomodate the dado-cutting blade pack.

The perspective view of FIG. 1 illustrates a conventional hand-held, portable, circular saw 10—as commonly employed in construction carpentry or millwork—equipped with an auxiliary groove-cutting assembly of the invention, including a guide plate 20, a blade guard 30 and a blade pack 40.

Figure 2:
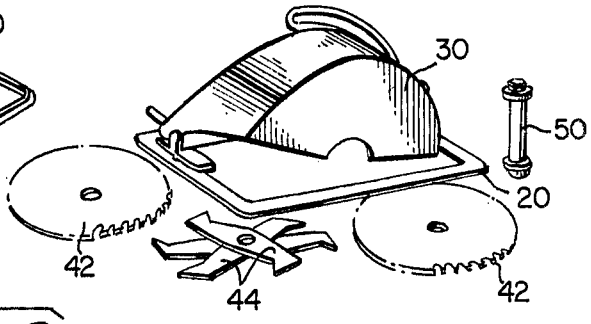
FIG. 2 is a perspective view of an axiliary dado shaft kit, as used to convert a typical portable saw from single-blade to groove-cutting operation.

By incorporating a small number of removable components—shown in the view of FIG. 2—after the removal of the original-equipment blade guard, saw blade and guide plate, the saw 10 is converted for grooving, dadoing and notching operations. These components include a removable dado shaft assembly 50, circular saw blades 42—constituting the flanking members of the dado blade pack 40—as well as a number of partial saw blades 44; in addition to the guide plate 20 and the blade guard 30, including the required attachment hardware, adjusting knobs and depth gage.

Figure 3:
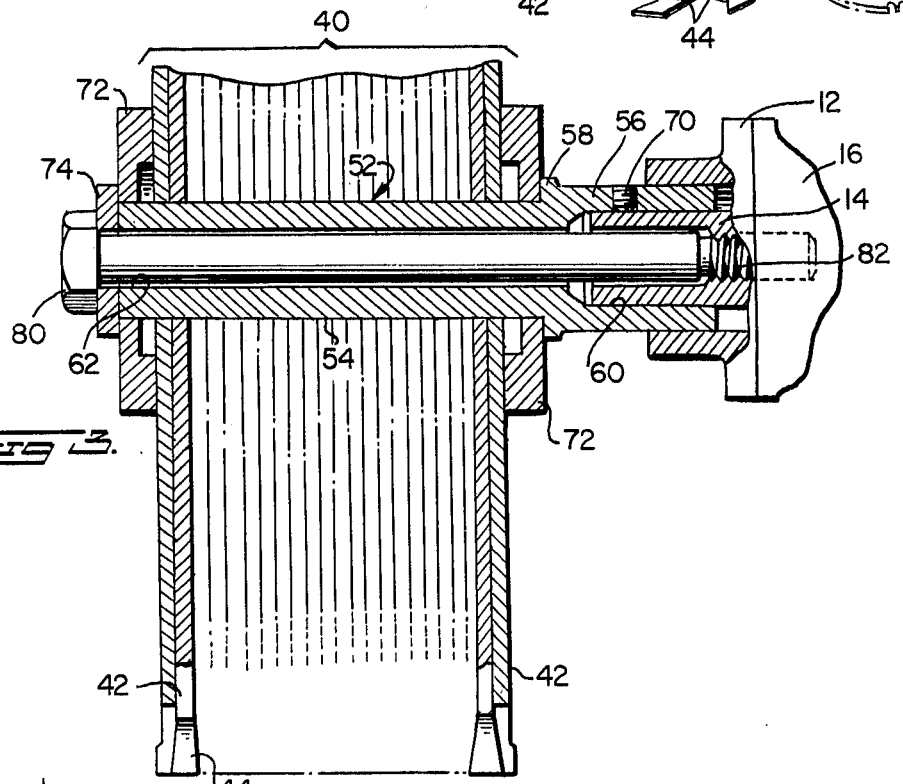
FIG. 3 is a longitudinal section through the interchangeable dado shaft, groove-cutting saw-blade pack and auxiliary components employed therewith, as utilized in the embodiment of FIG. 1.

The removable dado shaft assembly 50 is shown in detail in the longitudinal section of FIG. 3, taken along section line 3—3 in FIG. 1. The assembly comprises a dado shaft 52, setscrew 70, bearing washers 72, flatwasher 74 and bolt 80. The dado shaft 52 is provided with a constant-diameter shank 54 adjoined by a tubular socket 56 at one end. The boundary between the shank 54 and the socket 56 is defined by a flange 58 projecting radially from the shaft periphery and forming an abutment for receiving an inboard bearing washer 72. Shank 54 has an axial bore 62 including an enlarged internal bore 60 of the socket 56. The socket 56 is so dimensioned as to be a sliding fit on stub-shaft 14 of drive motor 16, forming an integral component of the saw 10. The stub-shaft 14 is surrounded by a tubular guard 12, the annulus between them receiving the end of the tubular socket 56. The setscrew 70 is adapted to secure the socket 56—and, consequently, the shaft 52—to the stub-shaft 14.

The blade pack 40, including the circular saw blades 42 at either flank and a plurality of partial saw blades 44 in between, is mounted on the shank 54 of the dado shaft 52 extending from inboard bearing washer 72 to another bearing washer adjacent to the end of the dado shaft. A bolt 80 is inserted into the orifice 62 of the shaft, with flatwasher 74 under the head of the bolt, and engages a mating threaded socket within the stub shaft 14.

It will be noted that it is preferred, and common practice, to make the bearing washers 72 hollow-ground, so as to confine their friction-generating surfaces to a peripheral land, while the axial load placed on them is centered on an internal cavity. This type of construction tends to induce an internal bending deformation of such washers and renders the uniform transfer of the lock-up load more certain. Depending on the construction of the saw 10, especially the sense of rotation of the drive motor 16 therein, the bolt 80 may be provided with right-handed or left-handed threads, so as to ensure that the torsional loads placed on the blade pack 40 will tend to tighten the bolt into its socket in the stub-shaft 14.

Figure 4:
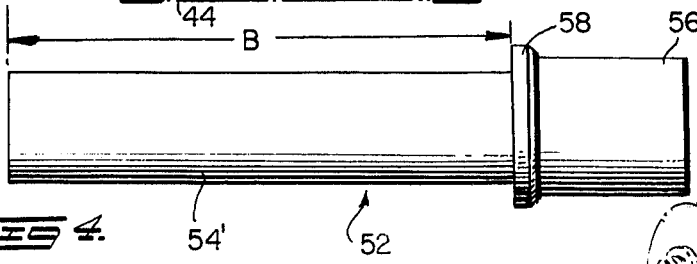
FIG. 4 is a planar aspect of a removable dado shaft of the invention.

The frontal view of FIG. 4 depicts a dado shaft 52', with shank 54'—so that the axial dimension of the latter corresponds to 'B'—somewhat longer than the similar shaft 52 shown in FIG. 3. The longer shaft 52' may be utilized to cut a correspondingly wider groove than is possible with the shaft 52, since a blade pack 40 incorporating a larger number of partial blades 44 can be mounted on it.

Figure 5:
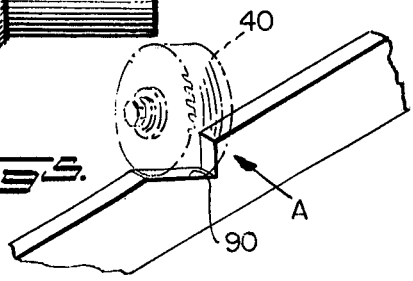
FIG. 5 is a schematic diagram, indicating the manner in which a saw-blade pack of parallel blades may be employed to notch a building rafter.

The nature of a typical notching operation which may be performed with the aid of the auxiliary dado shaft assembly of the invention is shown in FIG. 5, where a schematically depicted blade pack 40 is shown passing through—in the direction of the arrow 'A'—a board 90 being milled into a rafter, with the notch created by the passage of the dado pack 40 serving as the seat on the plate.

Figures 6, 7:
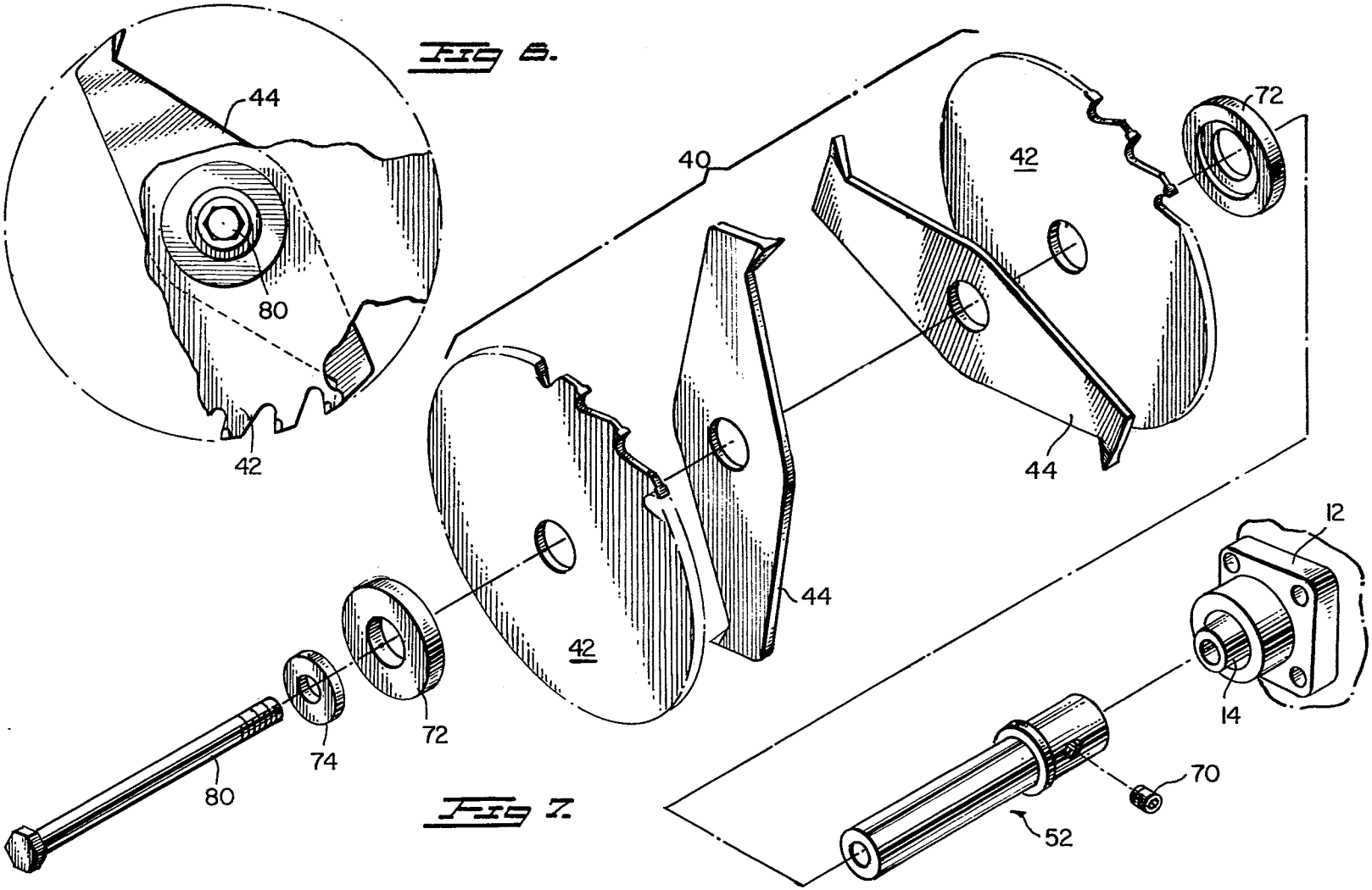
FIG. 6 is a partial end view of a dado-cutting blade pack, as installed on a removable dado shaft of the invention.
FIG. 7 is an exploded view of the several components of the interchangeable dado shaft assembly of the invention, as installed in the embodiment of FIG. 1.

The partial, frontal view of FIG. 6 illustrates the interaction between the multiple teeth disposed around the periphery of a circular saw blade 42 an the partial blades 44, each of which, in a commonly used embodiment, is provided with only two teeth at the ends of a substantially diametral blade. These single teeth are commonly of chisel form and wider than the thickness of the metal from which the partial blade 44 is cut, so as to overlap the adjoining blades and prevent the formation of thin wood laminae in any potential slot uncovered by any cutting tool.

The exploded view of FIG. 7 shows the coacting components of the dado shaft assembly 50 and the blade pack 40, as well as the components associated with the saw 10 which mount and drive the auxiliary dado device of the invention. The inactive components of a removable dadoing kit, as illustrated in FIG. 2, such as the guide plate 20 and the guard 30 are omitted in this view which encompasses only those parts necessary to perform the grooving/notching function of the dado attachment. The index numerals in FIG. 7 refer to components identical to, or similar, to equally numbered parts in the preceeding illustration. The dado shaft 50 is mounted on stub-shaft 14 as the first step in the assembly of the removable dado device to the saw 10, after the removal of the saw blade and mounting hardware associated therewith. As the next step in the assembly process the setscrew 70 is tightened against the surface of the stub-shaft 14, subsequent to which the washer 72 is placed on the dado shaft shank, with its cavity facing outwardly, away from the drive motor of the saw 10. The blade pack 40 is assembled next, by sliding the central orifices of the several cutting blades in the pack onto the shank of the shaft, and the outboard bearing washer 72 follows, with its cavity facing inwardly. The bolt 80 is then inserted into the shaft, with flatwasher 74 entrapped on the bolt shank, and tightened into the threaded cavity already provided in the stub-shaft 14, for purposes of mounting the original-equipment, single saw blade.

The components recited hereinabove are preferably placed into the stream of commerce in the form of a kit so as to enable anyone employed in construction and already in possession of a portable circular saw to convert it—in a short time and with little effort—into an efficient and safe grooving or notching saw equipped with a dado blade pack whose width is limited only by the length of the dado shaft shank. Narrower grooves are readily cut with the same assembly, substituting some washers outboard of the outer full saw blade 42 for such partial blades 44 as were removed to reduce the width of the blade pack to the desired dimension.

The invention has been described, hereinabove, with reference to its preferred embodiment, particularly adapted to service with construction-type portable saws, operated by electric motor drives through worm-gear transmissions. Similar auxiliary dado shaft assemblies can be readily constructed for service with portable circular saws of other types, entailing minor modifications of the attachment portions of the removable shaft and/or the securing bolt. Such changes, and other minor changes in the mechanical arrangement of the several parts as may occur to one skilled in the art of designing woodworking machinery upon exposure to the teachings herein, are deemed to be encompassed by the invention which is solely delimited by the appended claims.

The inventor claims:

1. A removable dado shaft assembly for mounting dado blade packs on portable saws having rotary shafts, comprising:

a dado shaft with a constant diameter shank having a radially extending abutment flange and a central bore, attachment means integral with said dado shaft and adjacent to the abutment flange for engaging said saw shaft, a lock-up bolt extending through said bore to engage a threaded axial opening in the rotary saw shaft, and clamping means to engage said dado blade pack on the dado shank intermediate the abutment flange and a head end portion of the lock-up bolt.

2. A removable dado shaft assembly according to claim 1, wherein:

said attachment means comprises a tubular socket adapted to extend about said rotary saw shaft.

3. A removable dado shaft assembly according to claim 2, wherein:

said attachment means further include at least one setscrew extending radially through the tubular socket to engage the rotary saw shaft.

4. A removable dado shaft assembly according to claim 3, wherein:

said clamping means includes a pair of hollow-ground bearing washers urged against the flanking blades of said dado blade pack upon securement of the assembly by said lock-up bolt adjacent said abutment flange.

5. As an article of commerce, a kit for converting a portable circular saw for grooving operations by mounting a dado blade pack on the saw shaft, said kit comprising:

a removable auxiliary dado shaft assembly including a shaft having an abutment flange and a bore, and a bolt adapted to extend through the dado shaft bore and threadedly engage a threaded opening in said saw shaft to clamp the blade pack relative to the flange, a blade guard adapted for mounting about said dado blade pack, and a guide plate adapted for attachment to said portable saw to position the blade pack relative to a workpiece to be cut.

6. As an article of commerce, a kit for converting a portable circular saw for grooving operations, said kit comprising:

a dado blade pack, a blade guard for the dado blade pack, a guide plate for attachment to the portable saw, a removable auxiliary dado shaft assembly comprising a dado shaft with a constant diameter shank having a radially extending abutment flange and a central bore, attachment means integral with said dado shaft and adjacent to the abutment flange for engaging said saw shaft, a lock-up bolt extending through said bore to engage a threaded axial opening in the rotary saw shaft, and clamping means to engage said dado blade pack on the dado shank intermediate the abutment flange and a head end portion of the lock-up bolt.

7. The article of commerce of claim 6, wherein:

said attachment means comprises a tubular socket adapted to extend about said rotary saw shaft.

* * * * *